US008192208B2

(12) United States Patent
Tamura et al.

(10) Patent No.: US 8,192,208 B2
(45) Date of Patent: Jun. 5, 2012

(54) ELECTRONIC PART AND LEAD

(75) Inventors: Hiroaki Tamura, Kawasaki (JP); Fumihiko Tokura, Kawasaki (JP)

(73) Assignees: Fujitsu Limited, Kawasaki (JP); Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/179,817

(22) Filed: Jul. 11, 2011

(65) Prior Publication Data

US 2012/0021617 A1 Jan. 26, 2012

(30) Foreign Application Priority Data

Jul. 22, 2010 (JP) ..... 2010-164676

(51) Int. Cl.
*H01R 12/00* (2006.01)

(52) U.S. Cl. ..... 439/83

(58) Field of Classification Search ..... 439/83, 439/876, 874

See application file for complete search history.

(56) References Cited

U.S. PATENT DOCUMENTS

| | | | | |
|---|---|---|---|---|
| 7,530,820 | B2 | 5/2009 | Jeon | |
| 7,950,963 | B2 * | 5/2011 | Mizukami et al. | 439/607.07 |
| 2008/0108233 | A1 * | 5/2008 | Jeon | 439/83 |
| 2011/0039429 | A1 * | 2/2011 | Mizukami et al. | 439/83 |
| 2011/0070752 | A1 * | 3/2011 | Yamashiro et al. | 439/83 |
| 2011/0111609 | A1 * | 5/2011 | Goto | 439/83 |
| 2011/0237094 | A1 * | 9/2011 | Takagi et al. | 439/55 |

FOREIGN PATENT DOCUMENTS

| | | | |
|---|---|---|---|
| JP | 5-121865 | A | 5/1993 |
| JP | 2000-261131 | A | 9/2000 |
| JP | 2008-282899 | A | 11/2008 |

* cited by examiner

*Primary Examiner* — Tulsidas C Patel
*Assistant Examiner* — Phuongchi Nguyen
(74) *Attorney, Agent, or Firm* — Westerman, Hattori, Daniels & Adrian, LLP

(57) ABSTRACT

A lead configured to join to a signal line of an electronic part through solder is disposed in an opposing relationship to the signal line and extends for sliding movement. A first opposing face section including a pair of faces having wettability to the solder is formed on surfaces of the signal line and the lead. Further, a second opposing face section including a pair of faces having wettability lower than the wettability of the first opposing face section is formed on the surfaces of the signal line and the lead along an extending direction of the lead.

20 Claims, 12 Drawing Sheets

ELECTRONIC PART AND LEAD

CROSS-REFERENCE TO RELATED APPLICATION

This application is based upon and claims the benefit of priority of the prior Japanese Patent Application No. 2010-164676, filed on Jul. 22, 2010, the entire contents of which are incorporated herein by reference.

FIELD

The embodiment disclosed herein is related to an electronic part such as a connector having an adjustable lead whose length can be adjusted.

BACKGROUND

In the past, a part called surface-mounted connector is known. The surface-mounted connector is a Part for providing removability to an electronic part to be mounted on a printed board. One of targets of application of the surface-mounted connector is an electronic part such as a different board, a semiconductor part or the like to be mounted on the printed board. The surface-mounted connector is hereinafter referred to simply as connector. The connector is suitable for use for collective mounting and dismounting of a plurality of conductors of an electronic part. Some of various connectors actually commercialized have a connector having electrodes of, for example, several tens to several hundreds of pins.

Generally, a great number of signal lines corresponding to electrodes are disposed in the inner side of the connector to be fixed to a printed board, and a lead is connected to an end of each signal line. The lead is fixed by solder to an electrode pad of the printed board and also the connector itself is fixed to the printed board.

incidentally, warping and unevenness of approximately several hundred [μm] to several [mm] exist on the surface of a printed board. Therefore, a gap sometimes appears between the electrode pad and the end of the lead when the connector is mounted on the printed board. Generally, solder is filled into such a gap as described above to secure bonding between the electrode pad and the lead.

However, in the case of a connector in which fine leads are disposed in high density, the area of the electrode pad on the printed board is set small and the solder amount for bonding the electrode pad and the lead is very small. Therefore, there is a subject that quality degradation and a bonding failure in solder bonding are likely to occur even if the distance between the electrode pad face and the end of the lead increases only a little.

Further, in a processor connector (socket) such as a PGA (Pin Grid Array), an LGA (Land Grid Array) or the like or a board connector whose bonded portion to a printed board is formed in a planar shape, an influence of warping is likely to be had in comparison with another connector in which leads are disposed in a row. Therefore, it is difficult to enhance the solder bonding performance of a lead.

Against such a subject as described above, a connector including a movable lead (adjustable lead) whose lead length can be adjusted has been developed. In particular, a slot is provided at an end portion of the connector along a signal line, and the movable lead is provided for sliding movement in the slot and is tacked to the signal line with solder paste. The tacked solder paste is melted upon reflowing, and the movable lead freely moves along the slot. Accordingly, the distance between the electrode pad face and the end of the movable lead can be changed while securing bonding between the movable lead and the signal line (for example, refer to U.S. Pat. No. 7,530,820).

However, in the connector described above, the movable lead is likely to contact with a wall of the slot and an operation failure of the movable lead by friction is likely to occur. Particularly, since a lead obtained from a lead frame formed by blanking (presswork) of a metal plate has an end face in the form of a rupture face, there is a subject that the lead is likely to catch on the slot wall and smooth sliding motion of the lead is likely to be obstructed.

On the other hand, it is also imaginable to form the slot wall sufficiently thicker than the lead in order to prevent contact between the lead and the slot wall. However, in this instance, since the disposing direction of the lead (direction in which the lead extends) and the direction of the lead face are not restricted by the slot wall, the lead is likely to be inclined with respect to the slot. In particular, the directions of leads projecting from the connector become irregular relative to each other, and consequently the quality of the solder bonding cannot be enhanced.

SUMMARY

According to an aspect of the embodiment, the disclosed electronic part is an electronic part including a lead extending for sliding movement on and in an opposing relationship to a signal line and configured to join to the signal line through solder. The electronic part includes a first opposing face section including a pair of faces formed in an opposing relationship to each other on surfaces of the signal line and the lead and having wettability to the solder. The electronic part further includes a second opposing face section including a pair of faces formed in an opposing relationship to each other on the surfaces of the signal line and the lead along an extending direction of the lead and having wettability lower than the wettability of said first opposing face section.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

In the following, an embodiment according to a present electronic part is described with reference to the drawings. However, the embodiment hereinafter described is illustrative to the end, and there is no intention to eliminate various modifications and applications of the technique not specified in the embodiment hereinafter described. In particular, the present disclosure can be carried out in various modified forms (combinations of the embodiment and modifications, and so forth) without departing from the spirit and scope of the present disclosure.

[1. Connector]

Figure 1A:
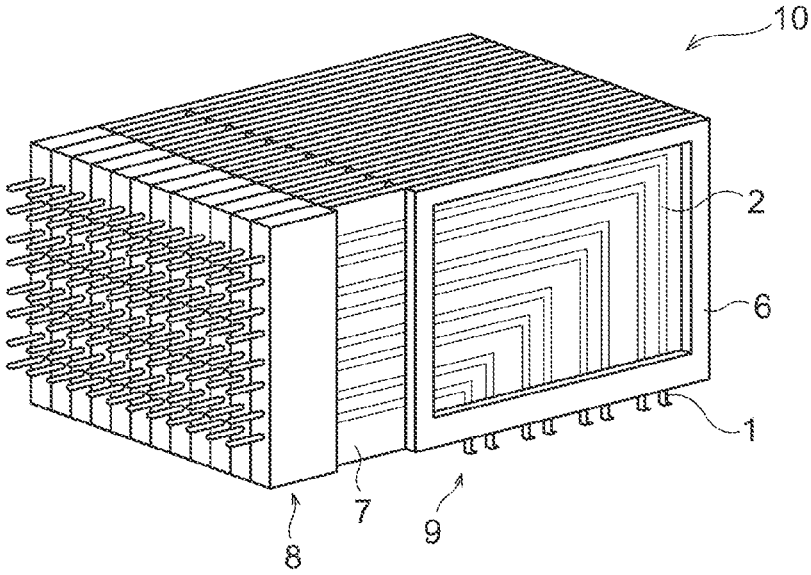
FIG. 1A is a perspective view illustrating a general configuration of an electronic part according to an embodiment.
Figure 1B:
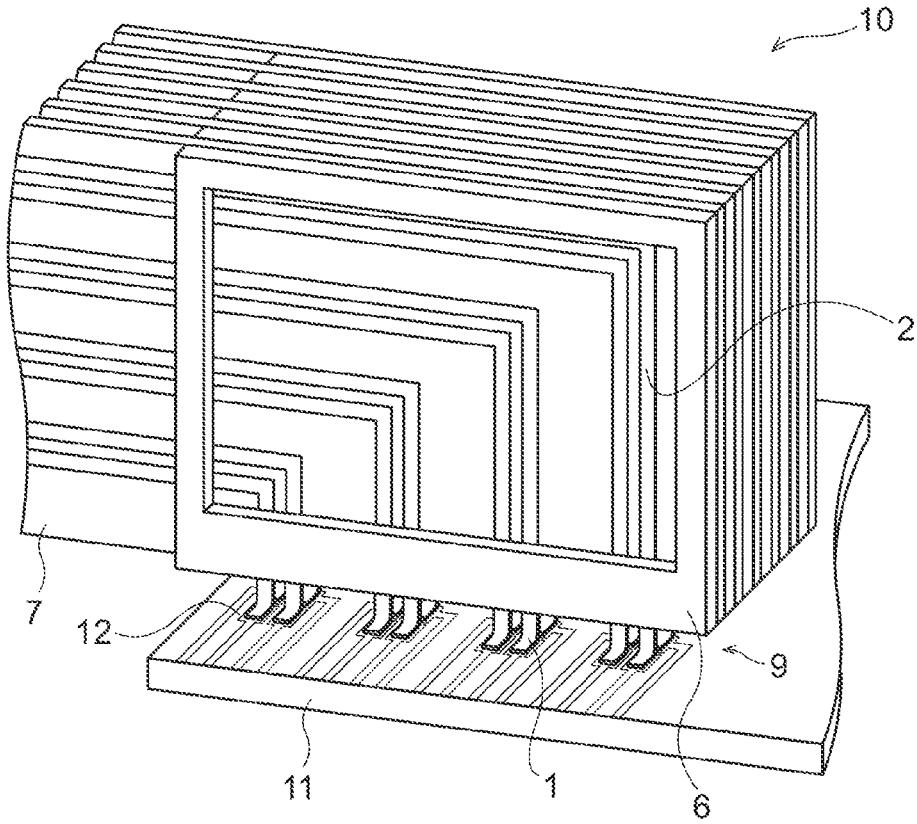
FIG. 1B is a perspective view illustrating a bonded portion of the electronic part according to the embodiment to a printed board.

FIGS. 1A and 1B are perspective views illustrating a configuration of a connector 10 (electronic part) according to the embodiment. The connector 10 is a part for connecting two printed boards (hereinafter referred to simply as boards) to each other, and includes a plurality of boards 7, a plurality of covers 6, a connection section 8 and a fixing section 9. The connection section 8 is a section on which a plurality of terminals to be connected to one of the boards, other connectors and the like are provided, and the fixing section 9 is a section from which a plurality of leads I soldered to the other one of the boards project. A number of terminals corresponding to the number of the leads 1 of the fixing section 9 are provided on the connection section 8.

On the surface of each of the boards 7, a circuit pattern is formed from signal lines 2 each formed from a conductor such as copper foil, conductive polymer or the like. The terminals of the connection section 8 are connected to the leads 1 of the fixing section 9 through the circuit pattern on the plural boards 7.

The plural boards 7 are laminated and fixed in a thickness-wise direction. Further, the covers 6 are fixed to the fixing section 9 side of the boards 7. The covers 6 are fixed in a closely contacting state with the boards 7. The covers 6 are individually provided with a function for covering and protecting a bonding portion between the signal lines 2 and the leads 1 on the boards 7 and another function for securing a gap between the laminated boards 7 by the thickness thereof. It is to be noted that each of the covers 6 is formed from a resin having insulating properties and each of the boards 7 is formed from a resin having insulating properties except the signal lines 2.

As illustrated in FIG. 1B, each cover 6 is provided such that it is aligned at a lower end thereof with a lower end of a board 7, and the fixing section 9 is provided at the lower ends of the covers 6 and the boards 7. The fixing section 9 is disposed in an opposing relationship to the surface of a substrate 11 which is a fixing target of the connector 10, and the leads 1 are fixed to electrode pads 12 formed on the substrate 11. An adjustable structure is applied to the individual leads 1 of the connector 10 of the present embodiment such that the projection length of the leads 1 from the lower end faces of the covers 6 and the boards 7 can be varied.

A disposing direction and an extending direction of the components are described below taking a state in which the top face of the substrate 11 is in a horizontal state and the lower end faces of the covers 6 and the boards 7 are in a horizontal state (state in which the surface of the boards 7 is in a vertical state) as a standard disposition posture. However, the term standard disposition posture here is used for the convenience of description, and it is not signified that the disposition posture of the cover 6, board 7 and substrate 11 is limited to this.

[2. Fixing Section]

Figure 2:
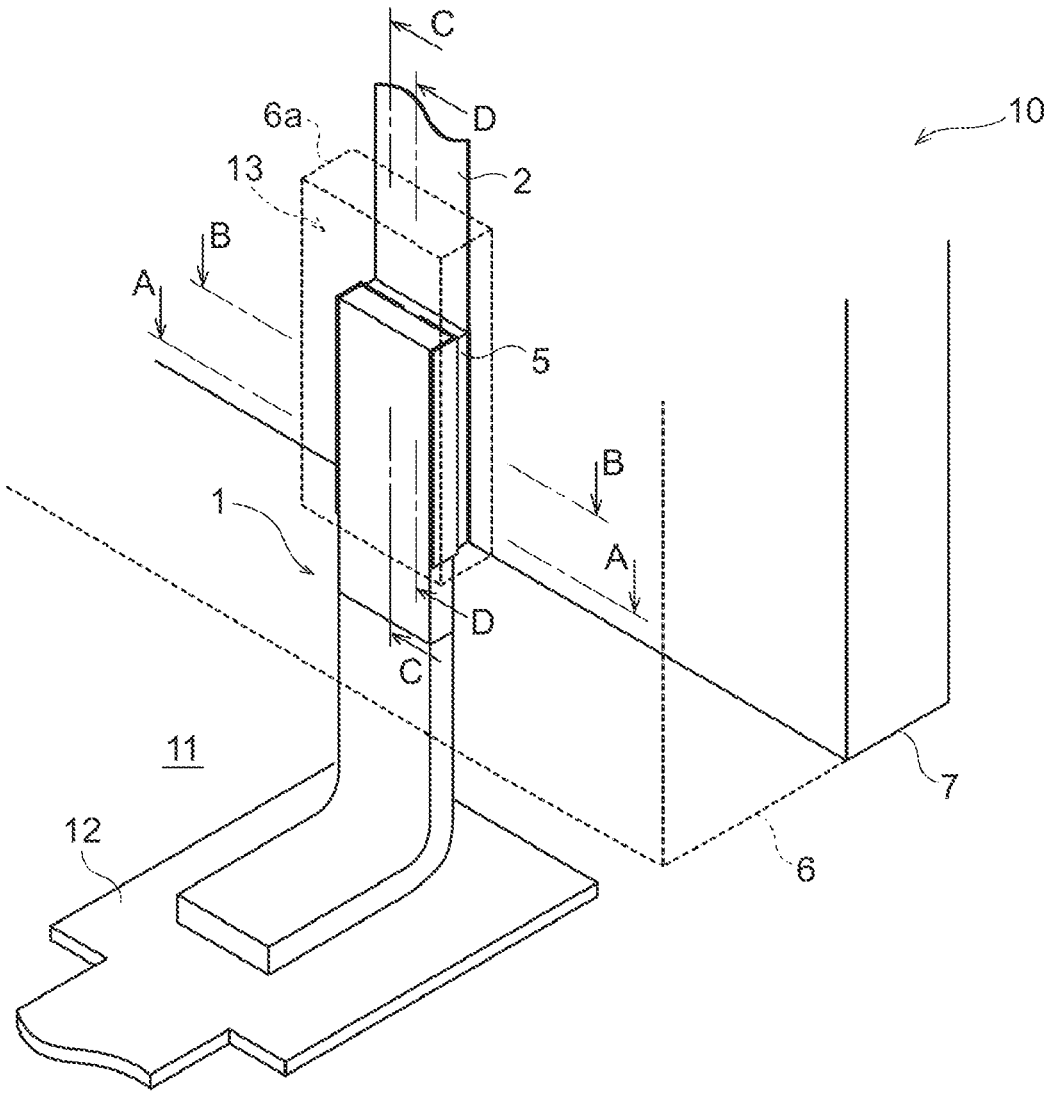
FIG. 2 is a perspective view illustrating a lead and a signal line as viewed through a cover of the electronic part of FIG. 1.

FIG. 2 is a view schematically illustrating an internal structure as viewed through a cover 6 in the proximity of the fixing section 9. Here, a contour line of the cover 6 is indicated by broken lines. The signal line 2 formed on a board 7 extends vertically with respect to the lower end faces of the cover 6 and the board 7. Further, a groove 6*a* having a shape along the extending direction of the signal line 2 is provided in a concave fashion on the cover 6. The extending direction of the signal line 2 is the vertical direction.

Figure 3:
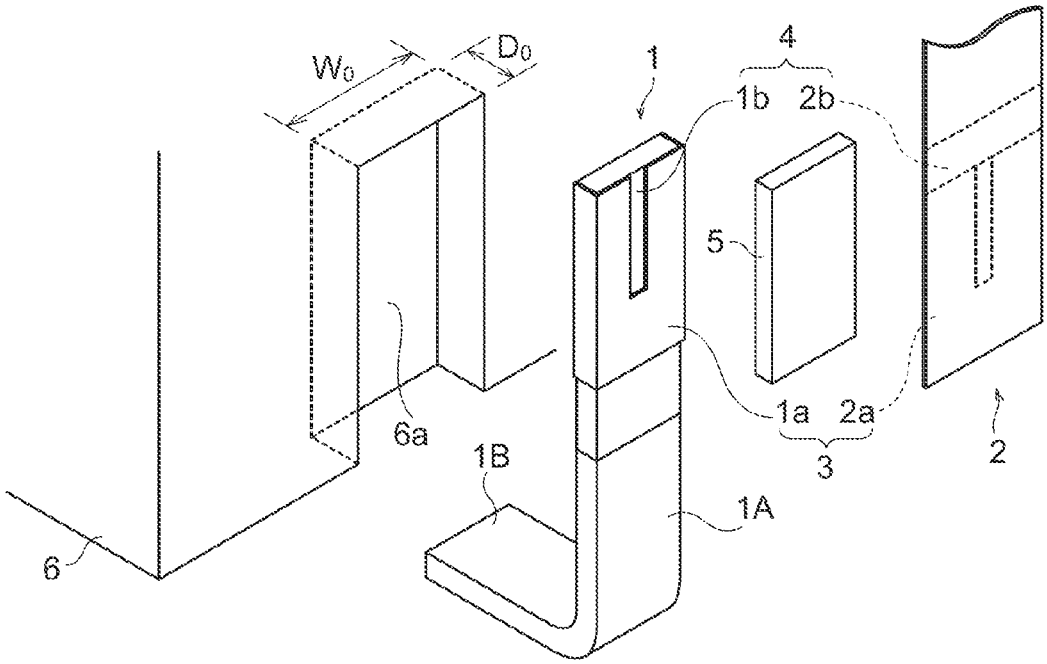
FIG. 3 is an exploded perspective view illustrating a configuration of part of the electronic part of FIG. 1.

As illustrated in FIG. 3, the groove 6*a* is formed as a rectangular parallelepiped-shaped hollow which is open at the lower end face of the cover 6 and the opposing face of the cover 6 to the board 7. Accordingly, a cavity 13 formed from the groove 6*a* and the board 7 has a vertically extending parallelepiped shape. In the inside of the cavity 13, a lead 1 and solder 5 are provided.

The lead 1 is a plate-shaped member formed by blanking and stamping a metal plate of, for example, iron nickel, copper alloy or the like with a precision metal die or formed by a precision cutting process using a laser light irradiation apparatus. The lead 1 includes an extending portion 1A on the upper side to be inserted into the cavity 13 and a bent portion 1B bent in a horizontal direction on the lower side. The extending portion 1A of the lead 1 has a form of a plate having a substantially fixed width and extends in the vertical direction. Further, the bent portion 1B is a portion in the form of a plate fixed to an electrode pad 12. It is to be noted that it is preferable to form the width of the extending portion IA smaller than that of the signal line 2 on the board 7.

The solder 5 is a metal bonding agent in the form of paste for fixing the extending portion 1A of the lead 1 to the signal line 2 in the cavity 13. The upper end side of the extending portion 1A of the lead 1 is tacked to the signal line 2 through the solder 5 of a suitable amount before reflowing.

it is to be noted that a groove width $W_0$ of the groove 6*a* is formed greater than the width of the extending portion 1A of the lead 1 and is formed greater than the width of the signal line 2. Further, a groove depth $D_0$ of the groove 6*a* is formed greater than the thickness of the lead 1 including the solder 5. Accordingly, for example, even if the solder 5 is melted upon reflowing, the lead 1 does not contact with the inner wall of the cavity 13. The lead 1 and the signal line 2 are pulled to each other by the interfacial tension of the molten solder 5 and the lead 1 is placed into a slidable state with respect to the signal line 2.

[3. Lead]

Figure 4A:
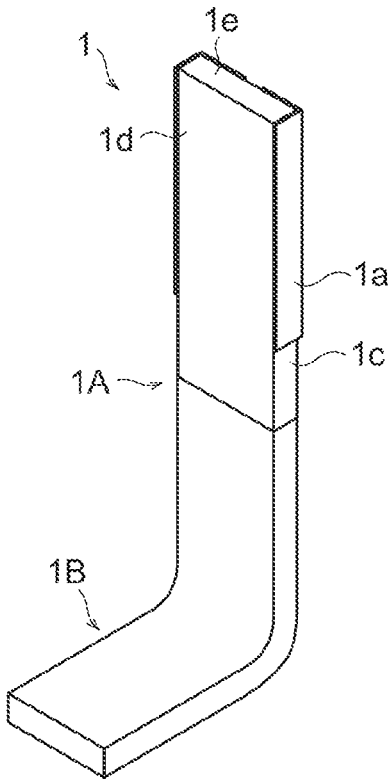
FIGS. 4A and 4B are perspective views of the lead of the electronic part of FIG. 1.
Figure 4B:
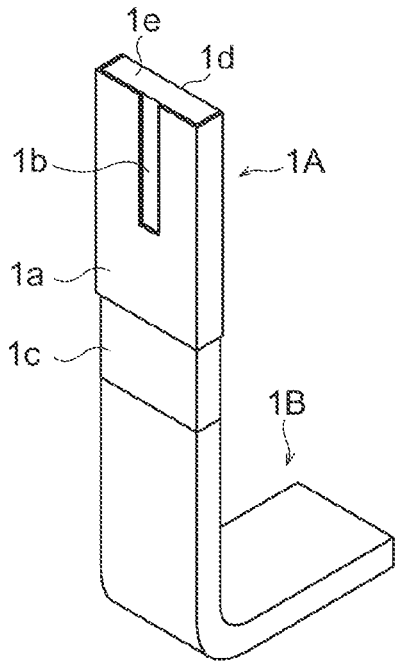
Figure 4C:
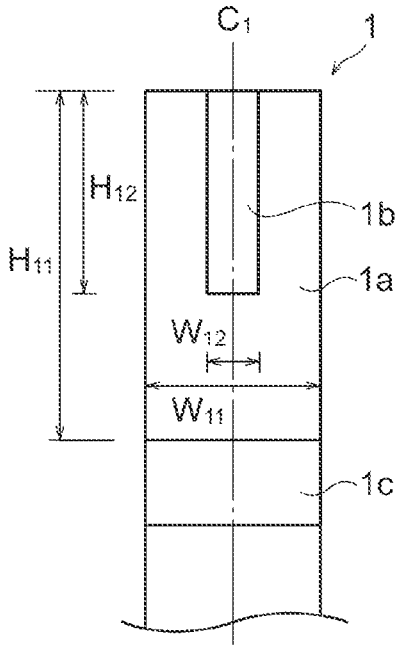
FIG. 4C is a side elevational view of the lead of the electronic part of FIG. 1.

As illustrated in FIGS. 4A to 4C, a plurality of regions which are different in wettability with respect to the solder 5 from each other, including a first lead region 1*a*, a second lead region 1*b* and a third lead region 1*c*, are formed on the surface of the extending portion 1A of the lead 1. It is to be noted that FIG. 4B illustrates the lead 1 same as that of FIG. 4A while changing the point of view.

The first lead region 1*a* is a region having high wettability and is formed by applying silver coating or gold plating to the matrix surface of metal such as, for example, iron nickel, copper alloy or the like. The wettability here signifies spreadability of the solder 5 on the fixing surface. The wettability is higher (greater) as the contact angle of the solder 5 with respect to the fixing surface is smaller, but the wettability is lower (smaller) as the contact angle is greater.

It is to be noted that the first lead region 1*a* may be formed by applying conductive resin for reducing the contact angle of the solder 5 with respect to the surface of the lead 1 or the like. Or, a face on which the spreading characteristic of the solder 5 is enhanced by a physical or chemical surface working process may be formed. The first lead region 1*a* is formed over the upper end side of the extending portion 1A to the left and right side faces of the extending portion 1A (end faces which form cut faces formed in a plate thicknesswise direction).

The second lead region 1*b* is a region having wettability lower than that of the first lead region la and is formed by exposing the matrix surface of metal such as, for example, iron nickel, copper alloy or the like. It is to be noted that the second lead region 1*b* may be formed by applying solder resist (resin film forming an insulation film) for increasing the contact angle of the solder 5 with respect to the surface of the lead 1, or a face on which the spreadability of the solder 5 is decreased by forming a film of nickel or copper alloy or a metal oxide film or the like may be formed.

The second lead region 1*b* is provided such that it extends vertically from an upper end edge of the extending portion 1A through the center (or a substantial center) of the first lead region 1*a* in the widthwise direction. As illustrated in FIG. 40, the second lead region 1*b* has a rectangular shape as viewed in a front elevation of the lead 1 and is formed along the extending direction of the extending portion 1A of the lead 1. A long side of the rectangular shape which forms a contour line of the second lead region 1*b* extends in parallel (vertically) to the extending direction of the lead 1 while an end side of the rectangular shape extends perpendicularly to the extending direction of the lead 1. Further, the second lead region 1*b* has a line-symmetric shape with respect to a center line $C_1$ as viewed in a front elevation of the lead 1 and the center of figure of the second lead region 1*b* is positioned on the center line $C_1$.

The dimension of the second lead region 1*b* in the vertical direction is set to a length with which the first lead region 1*a* is not cut. For example, as illustrated in FIG. 4C, where the dimension of the first lead region 1*a* in the vertical direction is represented by $H_{11}$ and the dimension of the second lead region 1*b* in the vertical direction is represented by $H_{12}$, the dimensions $H_{11}$ and $H_{12}$ are set such that an inequality $H_{11}>H_{12}$ is satisfied.

In this instance, while the first lead region 1*a* is provided so as to sandwich the second lead region 1*b* from the widthwise direction, the first lead region 1*a* is not fully cut by the second lead region 1*b*. One portion of the first lead region 1*a* is positioned adjacent to the left side of the second lead region 1*b* and the other one portion of the first lead region 1*a* is positioned adjacent to the right side of the second lead region 1*b*. The two portions of the first lead region 1*a* are connected (contiguous) to each other. That is, the first lead region 1*a* in which the second lead region 1*b* is interposed has unified shape.

It is to be noted that more preferably the dimensions $H_{11}$ and $H_{12}$ of the first lead region 1*a* and the second lead region 1*b* in the vertical direction are set such that an inequality $H_{11}>H_{12}\geqq(H_{11}/2)$ is satisfied. In particular, the dimension of the second lead region 1*b* in the vertical direction is set to one half or more of the dimension of the first lead region 1*a* in the vertical direction. The boundary between the first lead region 1*a* and the second lead region 1*b* forms part of the interface (boundary surface) of the solder 5 melted upon reflowing.

The dimension $W_{12}$ of the second lead region 1*b* in the widthwise direction is an arbitrary dimension and is suitably set in response to viscosity of the solder 5 or the temperature upon reflowing. The dimension $W_{12}$ may be set at least smaller than the dimension $W_{11}$ of the first lead region 1*a* in the widthwise direction. For example, the second lead region 1*b* maybe formed in a line shape or a bar shape along the extending direction of the lead 1 (the dimension $W_{12}$ is set to several tens to several hundreds [μm], or the like).

The third lead region 1*c* is a region whose wettability is lower than that of the first lead region 1*a* similarly to the second lead region 1*b* and is formed by exposing a matrix surface of metal such as, for example, iron nickel, copper alloy or the like. Or, the third lead region 1*c* is formed by surface working similarly to the second lead region 1*b*.

The third lead region 1*c* is provided in an adjacent relationship to a lower portion of the first lead region 1*a* and is formed zonally along the widthwise direction of the lead 1. As illustrated in FIG. 4B, the third lead region 1*c* is formed over the left and right side faces of the extending portion 1A of the lead 1.

A reverse face 1*d* and a top face 1*e* of the lead 1 illustrated in FIG. 4A are faces which do not oppose to the signal line 2 in the cavity 13 and are formed so as to have wettability lower than that of the first lead region 1*a* (for example, so as to have wettability same as that of the second lead region 1*b* or the third lead region 1*c*).

[4. Signal Line]

Figure 5A:
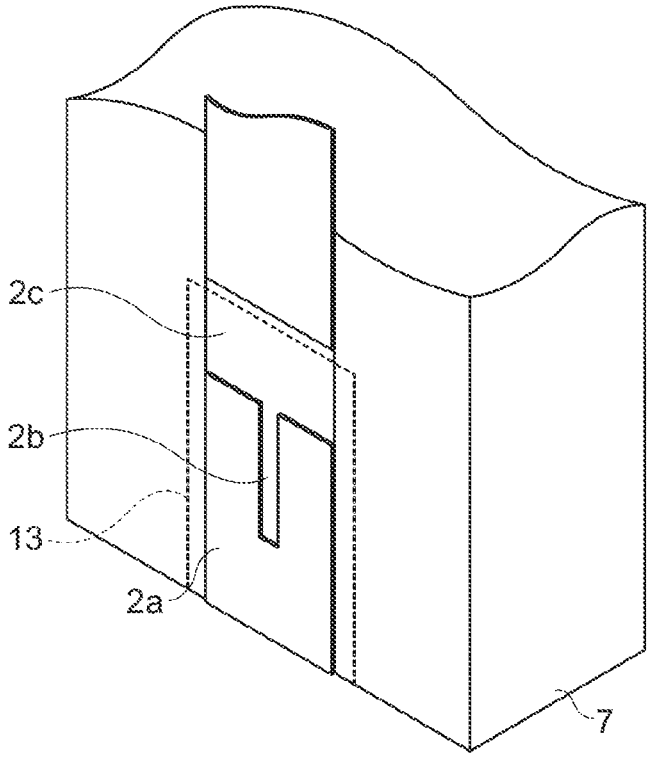
FIG. 5A is a perspective view of the signal line of the electronic part of FIG. 1.
Figure 5B:
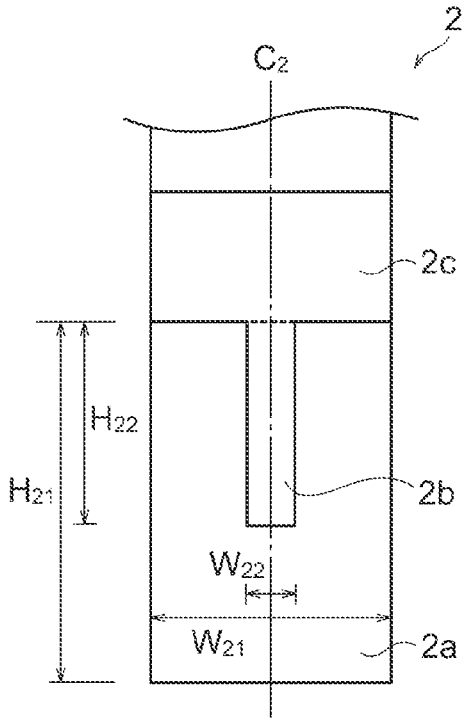
FIG. 5B is a side elevational view of the signal line of the electronic part of FIG.

As illustrated in FIGS. 5A and 5B, on the surface of a signal line 2, a plurality of regions which are different in wettability with respect to the solder 5 from each other, including a first signal line region 2*a*, a second signal line region 2*b* and a third signal line region 2*c*, are formed. It is to be noted that a broken line in FIG. 5B is an imaginary line indicating a boundary between the second signal line region 2*b* and the third signal line region 2*c* for the convenience of illustration.

The first signal line region 2*a* is a region whose wettability with respect to the solder 5 is high, and is formed, for example, by surface working similar to that performed for the first lead region la. The first signal line region 2*a* is formed at a lower end portion of the signal line 2. On the other hand, the second signal line region 2*b* and the third signal line region 2*c* are regions which are low in wettability with respect to the solder 5, and are formed, for example, by surface working (surface treating) similar to that performed for the second lead region 1*b* or the third lead region 1*c*.

The third signal line region 2*c* is provided adjacent to an upper portion of the first signal line region 2*a* and is formed zonally in the widthwise direction of the signal line 2. Further, the second signal line region 2*b* is formed vertically from a lower edge of the third signal line region 2*c* (from an upper edge of the first signal line region 2*a*) through the center (or a substantial center) of the first signal line region 2*a* in the widthwise direction. In particular, an upper end of the second signal line region 2*b* is connected to the third signal line region 2*c*. As illustrated in FIG. 5B, the second signal line region 2*b* has a rectangular shape as viewed in a front elevation of the signal line 2 and is formed along the extending direction of the signal line 2. Further, the second signal line region 2*b* has a line-symmetric shape with respect to the center line $C_2$ as viewed in a front elevation of the signal line 2, and the center of figure of the second signal line region 2*b* is positioned on the center line $C_2$.

The dimension of the second signal line region 2*b* in the vertical direction is set to a length with which the first signal line region 2*a* is not cut. For example, as illustrated in FIG. 5B, where the dimension of the first signal line region 2*a* in the vertical direction is represented by $H_{21}$ and the dimension of the second signal line region 2*b* in the vertical direction is represented by $H_{22}$, the dimensions $H_{21}$ and $H_{22}$ are set such that an inequality $H_{21}>H_{22}$ is satisfied.

In this instance, while the first signal line region 2*a* is provided so as to sandwich the second signal line region 2*b* from the widthwise direction, the first signal line region 2*a* is not fully cut by the second signal line region 2*b*. Part of the first signal line region 2*a* is positioned adjacent to the left side of the second signal line region 2*b* and the other part of the first signal line region 2*a* is positioned adjacent to the right side of the second signal line region 2*b*. The two parts of the first signal line region 2*a* are connected (contiguous) to each other. That is, the first signal line region 2*a* in which the second signal line region 2*b* is interposed has unified shape.

It is to be noted that more preferably the dimensions $H_{21}$ and $H_{22}$ of the first signal line region 2*a* and the second signal line region 2*b* in the vertical direction are set such that an inequality $H_{21}>H_{22}\geqq(H_{21}/2)$ is satisfied. In particular, the dimension of the second signal line region 2*b* in the vertical direction is set equal to or greater than one half the dimension of the first signal line region 2*a* in the vertical direction. A boundary between the first signal line region 2*a* and the second signal line region 2*b* forms part of the interface (boundary surface) of the solder 5 melted upon reflowing and functions as a portion at which tension of the solder 5 is uniformly applied between the boundary mentioned above and the boundary between the first lead region 1*a* and the second lead region 1*b*.

The dimension $W_{22}$ of the second signal line region 2*b* in the widthwise direction can be set arbitrarily and is suitably set in response to viscosity of the solder 5, the temperature upon reflowing or the like. The dimension $W_{22}$ may be set so as to be at least smaller than the dimension $W_{21}$ of the first signal line region 2*a* in the widthwise direction. Further, it is preferable to set the dimension $W_{21}$ of the first signal line region 2*a* in the widthwise direction so as to be greater than the dimension of the first lead region 1*a* in the widthwise direction ($W_{21}>W_{11}$). It is to be noted that the dimensional relationship between the widthwise dimension $W_{22}$ of the second signal line region 2*b* and the widthwise dimension $W_{12}$ of the second lead region 1*b* can be set arbitrarily.

[5. Working]

The first lead region 1*a* and the first signal line region 2*a* are disposed in an opposing relationship to each other as illustrated in FIG. 3 and function as a first opposing face section 3 having wettability with respect to the solder 5. Meanwhile, the second lead region 1*b* and the second signal line region 2*b* are disposed in an opposing relationship to each other and function as a second opposing face section 4 having wettability lower than that of the first opposing face section 3. The solder 5 is most likely to stick to the first lead region 1*a* on the surface of the extending portion 1A of the lead 1. Further, the solder 5 is most likely to stick to the first signal line region 2*a* on the surface of the signal line 2. While the solder 5 spreads on the faces to which the solder 5 is likely stick, it aggregates on the surfaces of the lead 1 and the signal line 2 which the surface area is minimized.

[5-1. Constraint of Movement in Lead Widthwise Direction]

A positional relationship in the horizontal direction between the lead 1 and the signal line 2 upon reflowing of the connector 10 illustrated in FIG. 2 is illustrated in FIGS. 6A to 6D.

If the solder 5 tacked between the lead 1 and the signal line 2 is melted, then the solder 5 tends to stick to the first lead region 1*a* and the first signal line region 2*a* rather than to the other regions. As a result, the solder 5 aggregates between the first lead region 1*a* and the first signal line region 2*a*, and interfacial force acts so that the surface area of the solder 5 is minimized on the interface between the solder 5 and air.

Figure 6A:
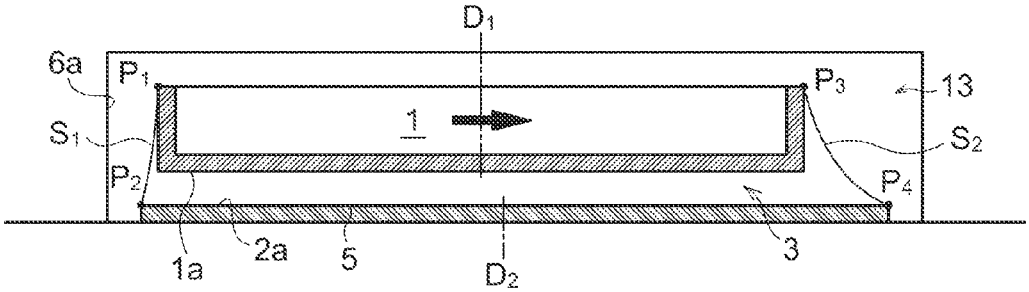
FIGS. 6A and 6B are sectional views taken along line A-A of FIG. 2.
Figure 6B:
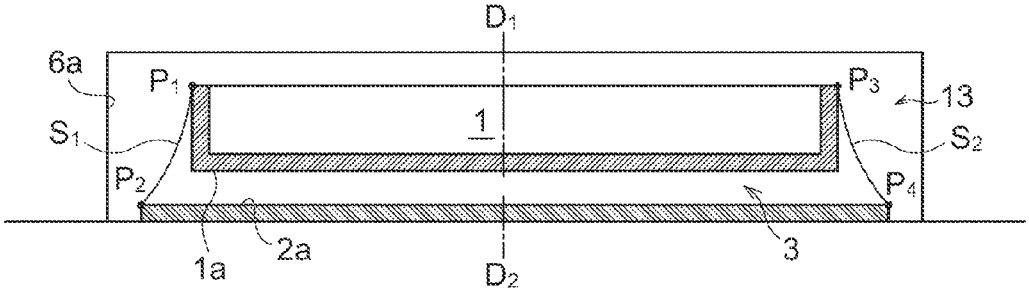
Figure 6C:
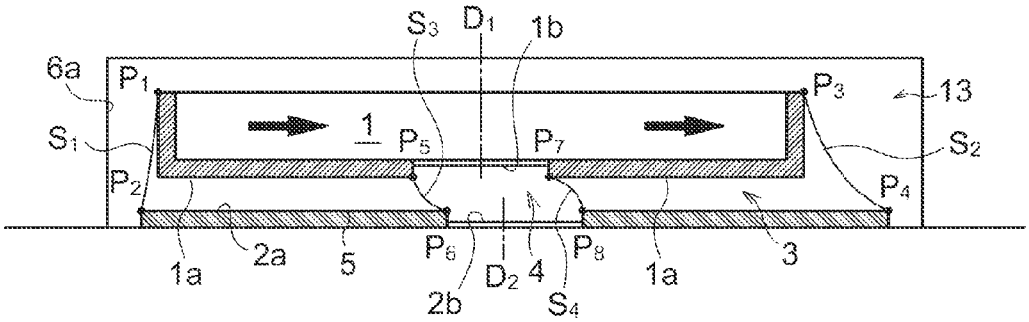
FIGS. 6C and 6D are sectional views taken along line B-B of FIG. 2.

Here, FIGS. 6A to 6C illustrate different positional relationships in which the positions in the widthwise direction of the center line $D_1$ of the lead 1 in the widthwise direction and the center line $D_2$ of the signal line 2 in the widthwise direction on a horizontal section are different from each other. From among the interfaces between the solder 5 and the air in the horizontal section, the interface formed on the left end face of the extending portion 1A of the lead 1 is referred to as first interface $S_1$, and the interface formed on the right end face of the extending portion 1A is referred to as second interface $S_2$.

As illustrated in FIG. 6A, the first interface $S_1$ is a curved face which connects the end edge $P_1$ of the first lead region 1*a* and the end edge $P_2$ of the first signal line region 2*a* to each other. Meanwhile, the second interface $S_2$ is a curved face which connects the end edge $P_3$ of the first lead region 1*a* and the end edge $P_4$ of the first signal line region 2*a* to each other.

When the center line $D_1$ of the lead 1 and the center line $D_2$ of the signal line 2 are not aligned with each other, the surface area of one of the first interface $S_1$ and the second interface $S_2$ is greater than that of the other one of the interfaces $S_1$ and $S_2$. For example, in FIG. 6A, the surface area of the second interface $S_2$ is greater than that of the first interface $S_1$. The solder 5 moves toward a position at which the sum between the surface areas is in the minimum, that is, toward a position at which the surface areas of the first and second interfaces $S_1$ and $S_2$ are equal to each other.

As indicated by a black arrow mark in FIG. 6A, the lead 1 is acted upon by force in a direction with which the position thereof in the widthwise direction coincides with the signal line 2. As a result, the position of the lead 1 in the widthwise direction with respect to the signal line 2 is corrected, and the center line $D_1$ of the lead 1 and the center line $D_2$ of the signal line 2 are aligned with each other as illustrated in FIG. 6B. It is to be noted that, even if the amount of the solder 5 before reflowing is not uniform in the widthwise direction of the lead 1, since the solder 5 flows on the first lead region 1*a* and the first signal line region 2*a*, the distribution of the solder 5 in the widthwise direction is uniformized as illustrated in FIG. 6A.

Figure 6D:
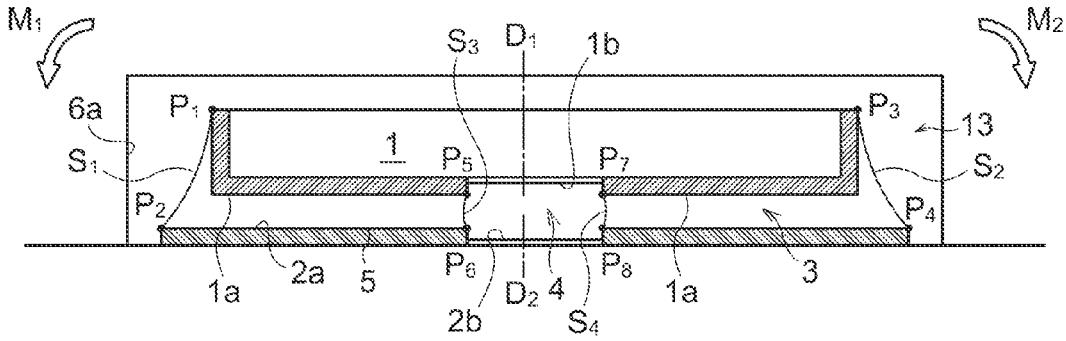

Further, as illustrated in FIGS. 6C and 6D, the interface between the solder 5 and the air on the horizontal section is formed from the boundary between the first lead region 1*a* and the second lead region 1*b* also to the boundary between the first signal line region 2*a* and the second signal line region 2*b*. Here, the interface which connects the left end edge $P_5$ of the second lead region 1*b* and the right end edge $P_6$ of the second signal line region 2*b* to each other is referred to as third interface $S_3$. Further, the interface which connects the right end edge $P_7$ of the second lead region 1*b* and the left end edge $P_8$ of the second signal line region 2*b* to each other is referred to as fourth interface $S_4$.

Since, when the center line $D_1$ of the lead 1 does not align with the center line $D_2$ of the signal line 2, the surface area of one of the third and fourth interfaces $S_3$ and $S_4$ is greater than the surface area of the other one of the interfaces, the solder 5 exerts the tension thereof to the lead 1 and the signal line 2 so that the sum of the surface areas described above is minimized. Accordingly, as indicated by black arrows in FIG. 6C, the lead 1 is acted upon by force in the direction with which the position thereof in the widthwise direction is aligned with the signal line 2. Consequently, the lead 1 moves toward a position at which the surface area of the third interface $S_3$ and the surface area of the fourth interface $S_4$ are equal to each other. As a result, the position of the lead 1 in the widthwise direction with respect to the signal line 2 is corrected, and the center line $D_1$ of the lead 1 and the center line $D_2$ of the signal line 2 are aligned with each other.

It is to be noted that the first interface $S_1$ and the third interface $S_3$ are face-symmetric with the second interface $S_2$ and the fourth interface $S_4$ with respect to a vertical plane which passes the center line $D_1$, respectively, and the force is not exerted with which the lead 1 moves in a rotation direction on the plane of FIG. 6. For example, moment $M_1$ which may be generated on the left end side of the lead 1 by the tension acting on the first interface $S_1$ and the third interface $S_3$ is balanced with moment $M_2$ which may be generated on the right end side of the lead 1 by the tension acting on the second interface $S_2$ and the fourth interface $S_4$. Accordingly, an inclination does not appear on the lead 1, and the surface of the lead 1 extends in parallel to the surface of the signal line 2.

[5-2. Movement in Lead Extending Direction]

Figure 7A:
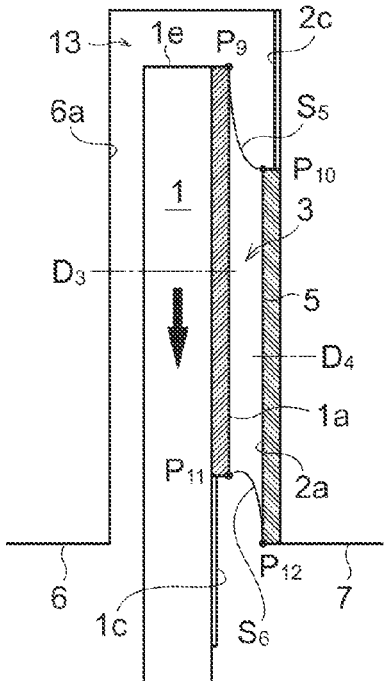
FIGS. 7A and 7B are sectional views taken along line C-C of FIG. 2.
Figure 7B:
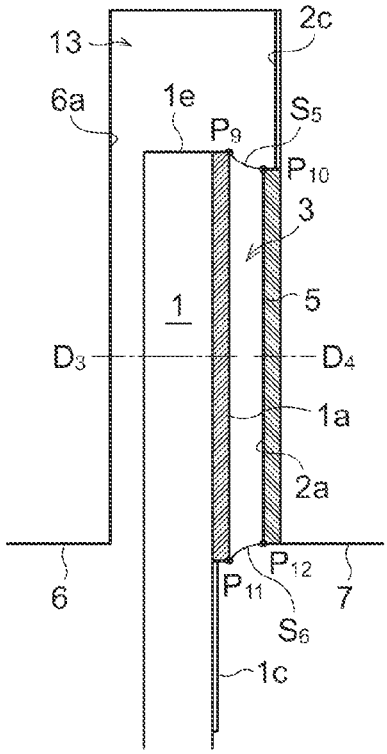
Figure 7C:
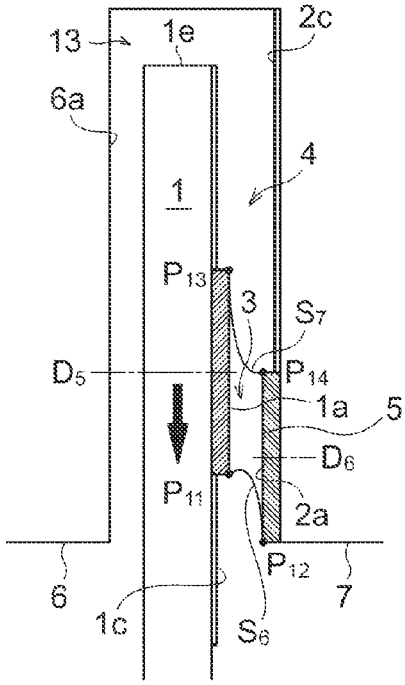
FIGS. 7C and 7D are sectional views taken along line D-D of FIG. 2.

A positional relationship in the vertical direction between the lead 1 and the signal line 2 upon reflowing of the connector 10 illustrated in FIG. 2 is illustrated in FIGS. 7A to 7D. In particular, FIG. 7A illustrates a positional relationship in a case in which the positions in the longitudinal direction of the center line $D_3$ of the first lead region 1*a* in the extending direction and the center line $D_4$ of the first signal line region 2*a* in the extending direction on a longitudinal section are different from each other. Meanwhile, FIG. 7C illustrates another positional relationship in a case in which the position in the longitudinal direction of the center line $D_5$ from the lower end of the second lead region 1*b* to the lower end of the first lead region 1*a* and the position in the longitudinal direction of the center line $D_6$ from the lower end of the second signal line region 2*b* to the lower end of the first signal line region 2*a* are different from each other.

Here, an interface of the solder 5 formed at the upper end of the lead 1 is referred to as fifth interface $S_5$, and another interface formed at the lower end of the signal line 2 is referred to as sixth interface $S_6$. A further interface formed on the lower ends of the second lead region 1*b* and the second signal line region 2*b* is referred to as seventh interface $S_7$.

The fifth interface $S_5$ is a curved face which connects the upper end edge $P_9$ of the first lead region 1*a* and the upper end edge $P_{10}$ of the first signal line region 2*a* to each other, and the sixth interface $S_6$ is a curved face which connects the lower end edge $P_{11}$ of the first lead region 1*a* and the lower end edge $P_{12}$ of the first signal line region 2*a* to each other. Further, the seventh interface $S_7$ is a curved face which connects the lower end edge $P_{13}$ of the second lead region 1*b* and the lower end edge $P_{14}$ of the second signal line region 2*b* to each other.

Since, when the center line $D_3$ of the lead 1 does not align with the center line $D_4$ of the signal line, the surface area of one of the fifth and sixth interfaces $S_5$ and $S_6$ is greater than the surface area of the other one of the interfaces, the solder 5 exerts the tension thereof to the lead 1 and the signal line 2 so that the sum of the surface areas is minimized. Accordingly, as indicated by a black arrow mark in FIG. 7A, the lead 1 is acted upon by force in a sliding direction with respect to the signal line 2 and moves toward a position at which the surface area of the fifth interface $S_5$ and the surface area of the sixth interface $S_6$ are equal to each other. As a result, the position of the lead 1 in the extending direction with respect to the signal line 2 is corrected and the center line $D_3$ of the lead 1 and the center line $D_4$ of the signal line 2 are aligned with each other as illustrated in FIG. 7B.

Meanwhile, since, when the center line $D_5$ of the lead 1 does not align with the center line $D_6$ of the signal line 2, the surface area of one of the sixth and seventh interfaces $S_6$ and $S_7$ is greater than the surface area of the other one of the interfaces, the solder 5 exerts the tension thereof to the lead 1 and the signal line 2 so that the sum of the surface areas is minimized. Accordingly, as indicated by a black arrow mark in FIG. 7C, the lead 1 is acted upon by force in a direction with which the position in the extending direction is aligned with respect to the signal line 2 and therefore moves toward a position at which the surface area of the sixth interface $S_6$ and the surface area of the seventh interface $S_7$ are equal to each other. As a result, the position of the lead 1 in the widthwise direction with respect to the signal line 2 is corrected and the center line $D_5$ of the lead 1 and the center line $D_6$ of the signal line 2 are aligned with each other as illustrated in FIG. 7D.

Figure 7D:
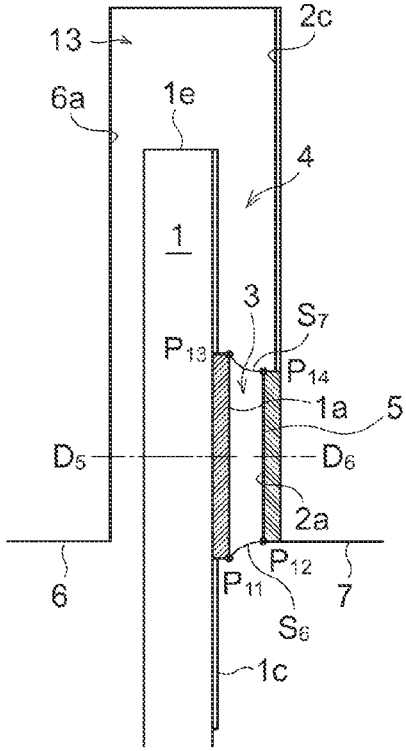

It is to be noted that the movable distance of the lead 1 in the extending direction corresponds to the distance from the position illustrated in FIG. 7A to the position illustrated in FIG. 7B or the distance from the position illustrated in FIG. 7C to the position illustrated in FIG. 7D. In particular, the movable distance of the lead 1 increases as the difference amount between the center lines and $D_4$ at a point of time before reflowing increases or the difference amount from the center lines $D_5$ and $D_6$ increases. Further, if the bent portion 1B side of the lead 1 contacts with the electrode pad 12 on the substrate 11 within a process in which the lead 1 moves from the position illustrated in FIG. 7A to the position illustrated in FIG. 7*b* upon reflowing, then the lead 1 is fixed at the contacting position just described with respect to the signal line 2.

[5-3. Constraint of Rotation]

Figure 8A:
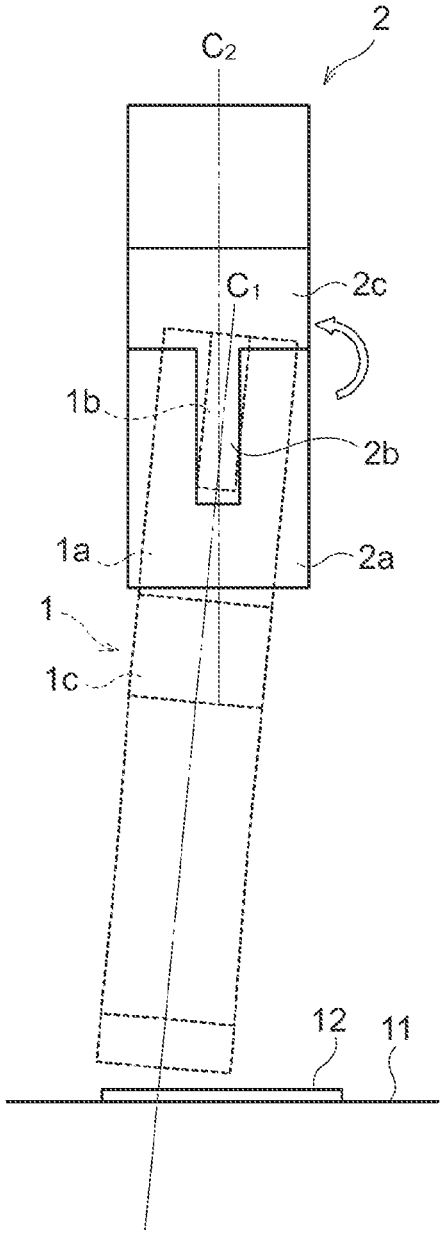
FIG. 8A is a side elevational view illustrating a state in which the lead is inclined with respect to the signal line in the electronic part of FIG. 1.

As illustrated in FIG. 8A, if rotation occurs with the lead 1 within a process of movement of the lead 1 with respect to the signal line 2, then there is the possibility that the position of the lead 1 on the bent portion 1B side may be moved by a great amount from a desired position and spaced away from the electrode pad 12 on the substrate 11. Further, if the left and right end faces (end faces) of the extending portion 1A of the lead 1 contact with and are caught by the inner walls of the groove 6a, then there is the possibility that the slidability of the lead 1 may be obstructed.

On the other hand, since the connector 10 described above is formed such that the first lead region la and the first signal line region 2*a* extend straight in the longitudinal direction of the lead 1, the tension acts on the lead 1 and the signal line 2 so that the third interface $S_3$ and the fourth interface $S_4$ are directed vertically.

Figure 8B:
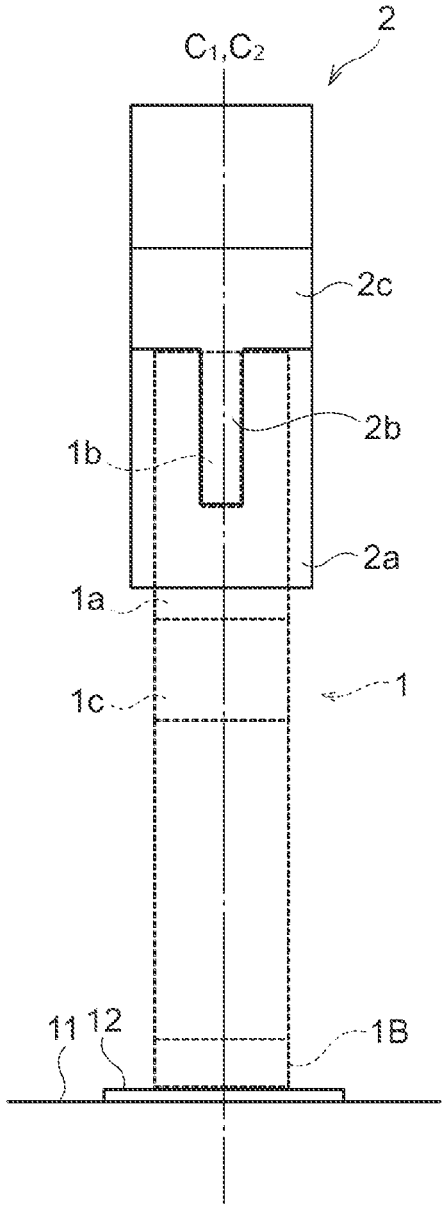
FIG. 8B is a side elevational view illustrating a state in which extending directions and opposing faces of the signal line and the lead in the electronic part of FIG. 1 are arranged in parallel to each other.

Accordingly, as indicated by a blank arrow mark in FIG. 8A, the lead 1 is acted upon by rotating force in a direction in which the center line $C_1$ of the lead 1 is aligned with the center line $C_2$ of the signal line 2. Consequently, the position of the lead 1 is corrected as illustrated in FIG. 8B.

[6. Effect]

In the connector 10 described above, since the second lead region 1*b* is formed along the extending direction (longitudinal direction) of the lead 1 and the second signal line region 2*b* is opposed to the second lead region 1*b*, the moving direction of the lead 1 can be limited and aligned accurately with the extending direction. Further, movement of the lead 1 in the widthwise direction (lateral direction) can be restricted and also the direction of the lead 1 can be maintained in the vertical direction. Consequently, accurate sliding motion of the lead 1 free from deflection can be secured and the sliding smoothness characteristic of the lead 1 can be enhanced.

Further, in the connector 10 described above, the groove 6*a* is formed greater than the lead 1 and the lead 1 contacts only with the solder 5 in the cavity 13. In particular, a function as a guide for controlling the moving direction of the lead 1 need not be applied to the groove 6*a*. Accordingly, the slidability of the groove 6a and the lead 1 can be improved without changing the dimensions and the accuracy of the groove 6*a* and the lead 1, and production of dust or the like by a sliding failure of the lead 1 and contact between the lead 1 and the groove 6*a* can be prevented.

Further, since the moving direction of the lead is controlled utilizing the tension distribution of the melted solder 5, the present disclosure can be applied even if the action of the weight is poor. For example, the present disclosure is suitable for use for enhancement of the sliding characteristic of a fine lead whose mass is little. In this instance, the extending direction and the sliding direction of the lead 1 are not limited to the vertical direction.

Further, in the connector 10 described above, the second lead region 1*b* is formed at the center of the lead 1 in the widthwise direction and the second signal line region 2*b* is formed at the center of the signal line 2 in the widthwise direction. Therefore, the center line $C_1$ of the lead 1 and the center line $C_2$ of the signal line 2 can be aligned with each other and displacement between the lead 1 and the signal line 2 can be prevented.

Further, since the distribution in the widthwise direction of the solder 5 melted upon reflowing is uniformized, the opposing faces of the lead 1 and the signal line 2 can be formed in parallel to each other.

Further, since the center lines of the lead 1 and the signal line 2 extend in parallel to each other, the shape of a side fillet formed by the solder 5 can be formed in a symmetric shape with respect to the center line of the side fillet. Consequently, connection strength between the lead 1 and the signal line 2 and the tension balance of the solder 5 in the widthwise direction can be adjusted, and the quality of the solder connection can be increased. Further, as illustrated in FIG. 6D, the moment which maybe exerted on the lead 1 can be balanced and rotation of the lead in a plane perpendicular to the extending direction of the lead 1 can be suppressed.

Further, in the connector 10 described above, the portions of the second lead region 1*b* on both sides of the first lead region 1*a* are formed in a shape in which they are connected to each other, and the portions of the second signal line region 2*b* on both sides of the first signal line region 2*a* are formed in a shape in which they are connected to each other. Accordingly, the fluidity of the solder 5 in the widthwise direction of the lead 1 can be secured, and consequently, the solder 5 can be distributed uniformly in the widthwise direction. For example, the position accuracy of the lead 1 and the signal line 2 after reflowing can be enhanced irrespective of the position accuracy of the solder 5 for connecting the lead 1 and the signal line 2 before reflowing. Further, by securing the fluidity of the solder 5 in the widthwise direction of the lead 1, rotation in a plane perpendicular to the extending direction of the lead 1 can be prevented with a higher degree of certainty, and the opposing faces of the lead 1 and the signal line 2 can be formed in parallel to each other.

Further, in the connector 10 described above, where the widthwise dimension $W_{11}$ of the first lead region 1*a* is set smaller than the widthwise dimension $W_{21}$ of the first signal line region 2*a*, the side fillet of the solder 5 which connects the lead 1 and the signal line 2 to each other can be formed with certainty.

Further, in the connector 10 described above, the third lead region 1*c* having low wettability is provided at a lower portion adjacent to the first lead region la and the third signal line region 2*c* having low wettability is provided also at an upper portion adjacent to the first signal line region 2*a*. Accordingly, the flowing range of the solder 5 melted upon reflowing can be limited upwardly with respect to the first lead region 1*a* on the lead 1 and can be limited downwardly with respect to the first signal line region 2*a* in the signal line 2. Consequently, overflowing and dropping of the solder 5 from the space between the lead 1 and the signal line 2 can be suppressed.

Further, in the connector 10 described above, where the dimension $H_{12}$ of the second lead region 1*b* is set to one half or more of the dimension of the first lead region 1*a* and the dimension $H_{22}$ of the second signal line region 2*b* is set to one half or more of the dimension $H_{21}$ of first signal line region 2*a*, rotation of the lead 1 in an in-plane direction can be suppressed. In particular, as illustrated in FIG. 8A, the center of rotation of the lead 1 in the in-plane direction is substantially aligned with the center of figure of the solder 5 flowing between the lead 1 and the signal line 2 and is placed in the proximity of the center of the first lead region 1*a* or the first signal line region 2*a*. Accordingly, by providing the second lead region 1*b* and the second signal line region 2*b* at the positions spaced from the center just described, force acting on the third interface $S_3$ and the fourth interface $S_4$ to suppress the rotation of the lead 1 can be reduced. Consequently, it is possible to suppress the rotation readily.

Further, if the lead 1 rotates in the in-plane direction as illustrated in FIG. 8A, then the bent portion 1B of the lead 1 moves to a position displaced from the electrode pad 12 on the substrate 11. Therefore, there is the possibility that the connection performance between the lead 1 and the electrode pad 12 may be disturbed. In Particular, there is the possibility that the bent portion 1B may not contact with the electrode pad 12, and, even if the bent portion 1B contacts with the electrode pad 12, a good solder fillet cannot be formed. On the other hand, in the connector 10 described above, since the bent portion 1B of the lead 1 is disposed in parallel to the electrode pad 12 face on the electrode pad 12 as illustrated in FIG. 8B, a good solder fillet can be formed with certainty and the connection performance between the lead 1 and the electrode pad 12 can be enhanced.

It is to be noted that, even if there is warping or unevenness on the surface of the substrate 11, since the lead 1 slidably moves accurately along the extending direction thereof, the extending portion 1A of the lead 1 and the signal line 2, and the bent portion 15 of the lead 1 and the electrode pad 12, can be connected with certainty to each other at the position at which the lead 1 contacts with the electrode pad 12.

[7. Modifications]

Irrespective of the example of the embodiment described above, variations and modifications can be made without departing from the scope of the present embodiment. The configuration and the processes of the present embodiment can be selected or may be suitably combined as occasion demands. In the modifications hereinafter described, like elements to those of the embodiment described above are denoted by like reference characters and description thereof is omitted.

[7-1. Swelling Suppression of Solder]

Figure 9A:
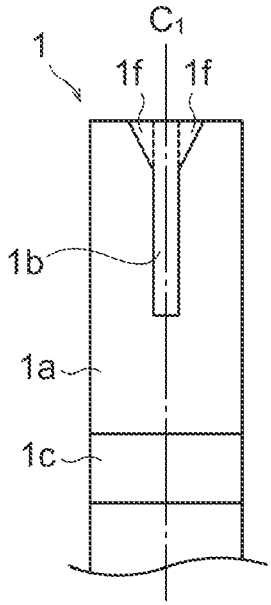
FIG. 9A is a side elevational view of a lead of an electronic part according to a modification.
Figure 9B:
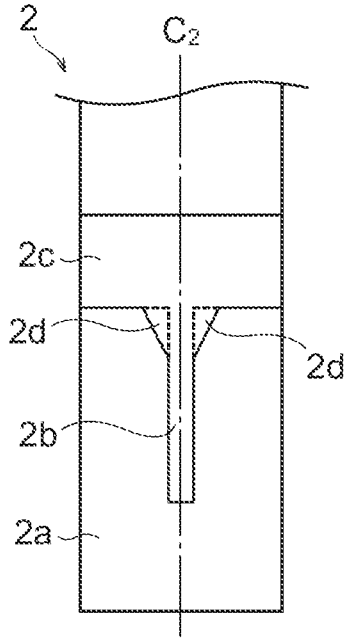
FIG. 9B is a side elevational view of a signal line of the electronic part according to the modification.

FIGS. 9A and 9B illustrate a modification in which the shape of the regions to be formed on the surfaces of the lead 1 and the signal line 2 of the embodiment described above is changed.

In the modification, the first lead region la, second lead region 1*b* and third lead region 1*c* as well as an edge lead region 1*f* are formed on the surface of the lead 1. The edge lead region 1*f* is a region having wettability lower than that of the first lead region 1*a* and is formed, for example, by surface working similar to that for the second lead region 1*b*.

The edge lead region 1*f* is a triangular-shaped region positioned at an angle portion of the first lead region 1*a* formed from the upper end edge and the second lead region 1*b* of the lead 1. In particular, the edge lead region 1*f* is a portion enclosed by the first lead region 1*a*, second lead region 1*b* and upper end edge of the lead 1.

As illustrated in FIG. 9B, on the surface of the signal line 2, the first signal line region 2*a*, second signal line region 2*b* and third signal line region 2*c* as well as an edge signal line region 2*d* are formed. The edge signal line region 2*d* is a region having wettability lower than that of the first signal line region 2*a* and is formed, for example, by surface working similar to that of the second signal line region 2*b*.

The edge signal line region 2*d* is a triangular-shaped region positioned at an angular portion of the first signal line region 2*a* formed from the second signal line region 2*b* and the third signal line region 2*c*. In particular, the edge signal line region 2*d* is a portion enclosed by the second signal line region 2*b*, third signal line region 2*c* and edge signal line region 2*d*.

If it is considered that the wettability values of the edge lead region 1*f* and the second lead region 1*b* are substantially equal to each other, then it can be considered that the edge lead region 1*f* is part of the second lead region 1*b*. Similarly, it can be considered that the edge signal line region 2*d* is part of the second signal line region 2*b*. In particular, in the modification illustrated in FIGS. 9A and 9B, the dimensions in the widthwise direction at the upper end of the second lead region 1*b* and the second signal line region 2*b* are enlarged.

Figure 9C:
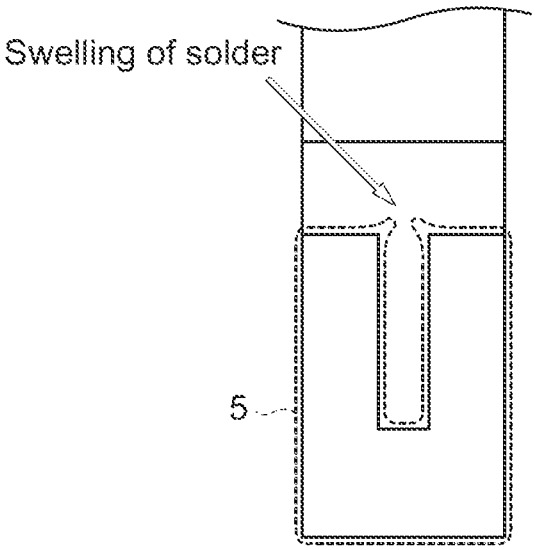
FIG. 9C is a view illustrating a swelling phenomenon of solder melted on a lead and a signal line as a comparative example.

By such a configuration as described above, the swelling phenomenon of the solder 5 on the left and right sides across the second lead region 1*b* and the second signal line region 2*b* upon reflowing can be prevented. It is to be noted that the swelling phenomenon is a phenomenon that, where there is a sharp angular portion at an edge portion of the face having high wettability, the solder 5 aggregates in the proximity of the sharp angular portion and the aggregated solder 5 swells to the face having low wettability as illustrated in FIG. 9C. If the edge ends of the first lead region 1*a* and the first signal line region 2*a* individually have a sharp edge shape, then there is the possibility that the solder 5 may swell in the proximity of the edge and the swelling portions of the solder 5 at the left and right sides across the second lead region 1*b* and the second signal line region 2*b* may be connected to each other.

On the other hand, in the modification, a sharp angle edge portion is eliminated from the edge ends of the first lead region 1*a* and the first signal line region 2*a* by providing the edge lead region 1*f* and the edge signal line region 2*d*. In this manner, by increasing the dimensions in the widthwise direction at the upper end of the second lead region 1*b* and the second signal line region 2*b*, the swelling phenomenon can be suppressed and it can be prevented that the swelling portions of the solder 5 are connected to each other across the second lead region 1*b* and the second signal line region 2*b*.

[7-2. Rotation Suppression of Lead]

Figure 10A:
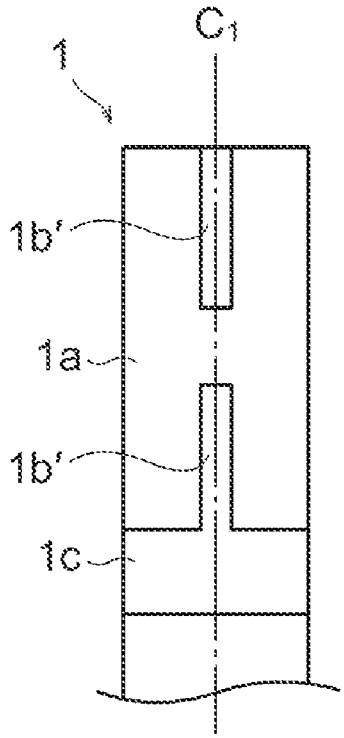
FIG. 10A is a side elevational view of the lead of the electronic part according to the modification.
Figure 10B:
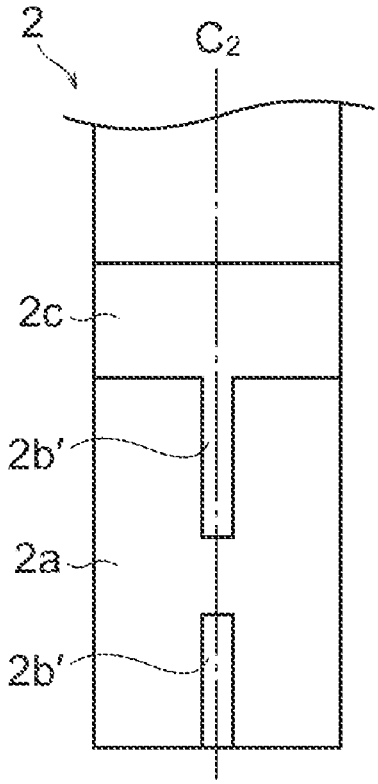
FIG. 10B is a side elevational view of the signal line of the electronic part according to the modification.

Also, FIGS. 10A and 10B illustrate a different modification in which the shape of the regions to be formed on the surfaces of the lead 1 and the signal line 2 of the embodiment described above is changed. In the present modification, a second lead region 1*b*' and a second signal line region 2*b*' are disposed divisionally in two segments in the extending direction of the lead 1 on the surface of the lead 1.

As illustrated in FIG. 10A, the second lead region 1*b*' is provided vertically passing the center of the first lead region 1*a* in the widthwise direction such that the segments thereof extend from the upper edge of the extending portion 1A and the lower edge of the first lead region 1*a* toward the center of the first lead region 1*a*. The second lead region 1*b*' has a line symmetric shape with respect to the center line $C_1$ as viewed in a front elevation of the lead 1, and the center of figure of the second lead region 1*b*' is positioned on the center line $C_1$.

Further, the dimension of each segment of the second lead region 1*b*' in the vertical direction is set to a length with which the first lead region 1*a* is not cut in the widthwise direction. In particular, while the first lead region 1*a* is provided so as to sandwich the second lead region 1*b*' from the widthwise direction, the first lead region 1*a* is not fully cut by the second lead region 1*b*'.

As illustrated in FIG. 10B, the second signal line region 2*b*' is vertically provided passing the center of the first signal line region 2*a* in the widthwise direction such that the segments thereof extend from the lower edge of the third signal line region 2*c* and the lower end edge of the signal line toward the center of the first signal line region 2*a*. The second signal line region 2*b*' has a line-symmetric shape with respect to the center line $C_2$ as viewed in a front elevation of the signal line 2, and the center of figure of the second signal line region 2*b*' is positioned on the center line $C_2$.

Further, the dimension of each segment of the second signal line region 2*b*' in the vertical direction is set to a length with which the first signal line region 2*a* is not cut in the widthwise direction. In particular, while the first signal line region 2*a* is provided so as to sandwich the second signal line region 2*b*' from the widthwise direction, the first signal line region 2*a* is not fully cut by the second signal line region 2*b*'.

The second lead region 1*b*' and the second signal line region 2*b*' opposed to each other function as a second opposing face section 4. In the present modification, the second opposing face section 4 is disposed at two positions in a dispersed relationship from each other spaced away from the center of rotation of the lead 1 in the in-plane direction. Accordingly, the rotation of the lead 1 in the in-plane direction can be prevented with certainty. It is to be noted that the rotation suppression effect is enhanced as the second opposing face section 4 is disposed in a spaced relationship by a greater distance from the center of rotation.

[7-3. Movable Distance of Lead]

Figure 11A:
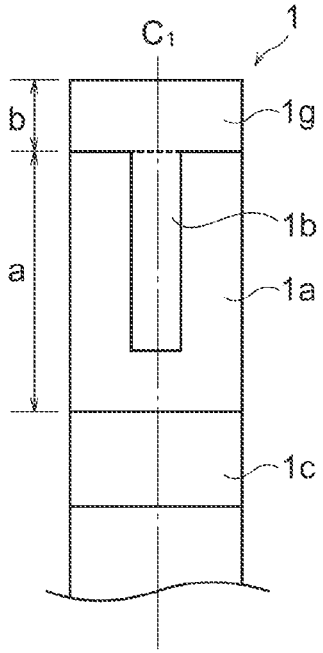
FIG. 11A is a side elevational view of the lead of the electronic part according to the modification.
Figure 11B:
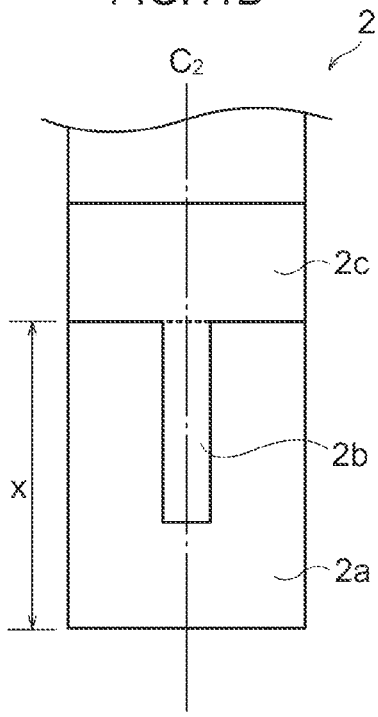
FIG. 11B is a side elevational view of the signal line of the electronic part according to the modification.

FIGS. 11A and 11B are schematic views of a modification regarding setting of a shape and a dimension of the region to be formed on the surface of the lead 1 of the embodiment described above. In the present modification, the first lead region 1*a*, second lead region 1*b* and third lead region 1*c* as well as a fourth lead region 1*g* are formed on the surface of the lead 1.

The fourth lead region 1*g* is a region formed zonally in the widthwise direction of the lead 1 at an uppermost end portion of the extending portion 1A. The fourth lead region 1*g* is formed as a region having wettability lower than that of the first lead region 1*a* and is formed, for example, by surface working similar to that for the second lead region 1*b*.

Here, where the dimension of the first lead region 1*a* in the vertical direction is represented by A and the dimension of the fourth lead region 1*g* in the vertical direction is represented by B, the dimension X of the first signal line region 2*a* in the vertical direction is set within a range which satisfied the following expression:

$$X \leqq A+2B \quad \text{(Expression 1)}$$

Or, if the dimension A of the first lead region 1*a* in the vertical direction and the dimension X of the first signal line region 2*a* in the vertical direction are given, then the dimension B of the fourth lead region 1*g* in the vertical direction is set within a range which satisfied the following expression:

$$B \geqq (X-A)/2 \quad \text{(Expression 2)}$$

Figure 11C:
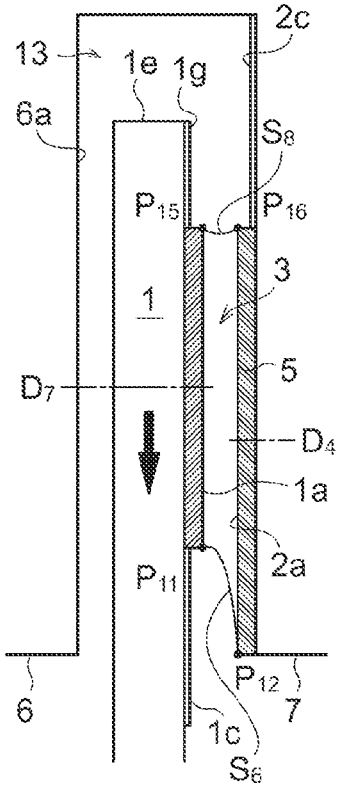
FIGS. 11C and 11D are vertical sectional views illustrating operation of the lead of the electronic part according to the modification.
Figure 11D:
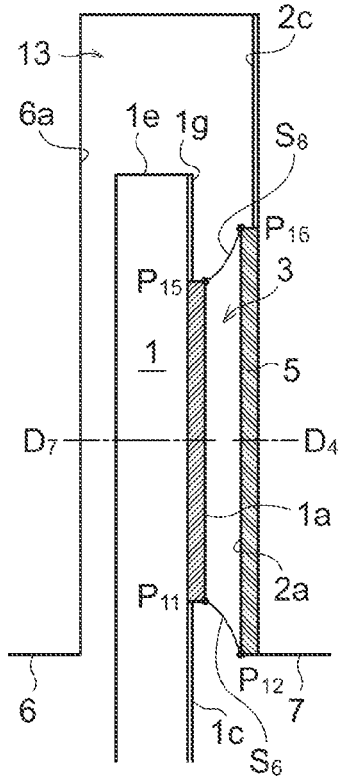

A positional relationship in the vertical direction between the lead 1 and the signal line 2 upon reflowing of the connector 10 in which such setting of the shape and the dimension of the regions as described above is applied is illustrated in FIGS. 11C and 11D. FIG. 11*c* illustrates an initial state upon starting of reflowing and FIG. 11D illustrates a stabilized state in which the lead 1 is moved in a vertically downward direction. Here, the interface of the solder 5 formed at the upper end of the first lead region 1*a* is referred to as eighth interface $S_8$. The eighth interface $S_8$ is formed as a curved face which connects the upper end edge $P_{15}$ of the first lead region 1*a* and the upper end edge $P_{16}$ of the first signal line region 2*a* to each other.

Since the fourth lead region 1*g* is provided contiguously to an upper portion of the first lead region la, the eighth interface of the solder 5 is positioned lower than the top face 1*e* of the lead 1. Further, when the solder 5 is melted upon reflowing, the lead 1 is acted upon by force in a sliding direction with respect to the signal line 2 as indicated by a black arrow mark in FIG. 11C.

The position of the lead 1 is stabilized at a position at which the center line $D_7$ of the lead 1 in the extending direction and the center line $D_4$ of the first signal line region 2*a* in the extending direction are aligned with each other. Accordingly, the movable distance of the lead 1 is (X−A)/2. On the other hand, if the fourth lead region 1*g* of the lead 1 is greater than the movable distance, then the top face 1*e* of the lead 1 projects upwardly from the eighth interface in the state in which the position of the lead 1 is stable.

In this manner, with the present modification, the fourth lead region 1*g* can always be projected upwardly with respect to the first signal line region 2*a* and solder leak from the top face 1*e* side of the lead 1 can be prevented irrespective of the sliding movement amount of the lead 1. It is to be noted that, since the surface tension of the solder 5 acts upon the eighth interface $S_8$, even if the top face 1*e* of the lead 1 is not positioned upwardly with respect to the first signal line region 2*a*, the solder 5 may not blow out from the top face 1*e* depending upon a heating method, a heat amount or the like upon reflowing. Accordingly, if the fourth lead region 1*g* is provided contiguously at least to an upper portion of the first lead region 1*a*, then solder leak from the top face 1*e* side of the lead 1 can be suppressed.

Further, since the molten solder 5 is not lost from between the lead 1 and the signal line 2, rotation of the lead 1 in a perpendicular plane with respect to the extending direction can be prevented with certainty, and the opposing faces of the lead 1 and the signal line 2 can be kept in parallel to each other.

[7-4. Others]

While, in the embodiment and the modification described above, the second lead region 1*b* and the second signal line region 2*b* which function as the second opposing face section 4 are formed along the lead 1 and center lines $C_1$ and $C_2$ of signal line 2, respectively, various particular shapes may be applied to the regions.

Figure 12A:
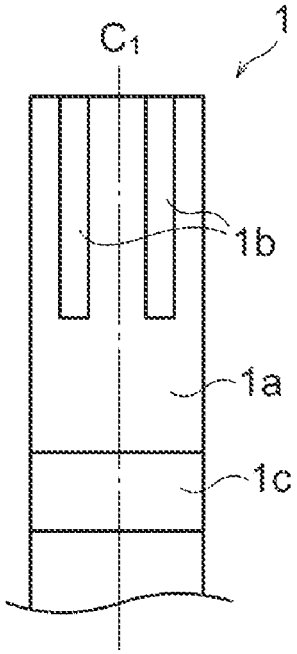
FIG. 12A is a side elevational view of the lead of the electronic part according to the modification.
Figure 12B:
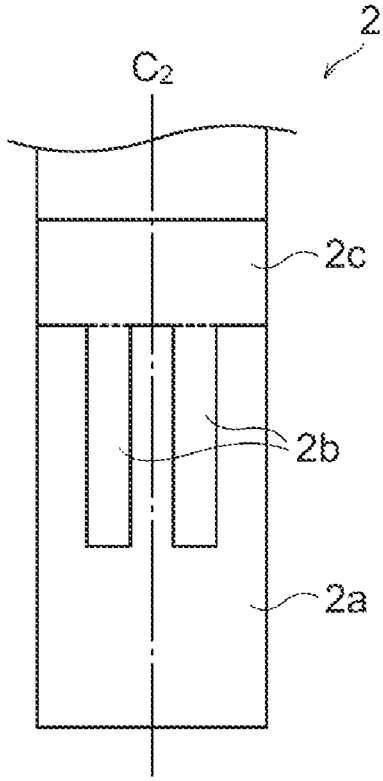
FIG. 12B is a side elevational view of the signal line of the electronic part according to the modification.

For example, it is imaginable to dispose a plurality of second opposing face sections 4 juxtaposed in a plurality of rows in the widthwise direction of the lead 1. In an example illustrated in FIGS. 12A and 12B, second lead regions 1*b* and second signal line regions 2*b* are individually provided in two rows. The second lead regions 1*b* have a line-symmetrical shape with respect to the center line $C_1$ as viewed in a front elevation of the lead 1, and the center of figure of the second lead regions 1*b* is positioned on the center line $C_1$. Similarly, the second signal line regions 2*b* have a line-symmetrical shape with respect to the center line $C_2$ as viewed in a front elevation of the signal line 2, and the center of figure of the second signal line regions 2*b* is positioned on the center line $C_2$.

With such a configuration as described above, the constraining action of the lead 1 in the widthwise direction can be strengthened, and it is possible to make the moving direction of the lead 1 coincide accurately with the extending direction of the lead 1 thereby to further enhance the slidability of the lead 1.

Further, in the embodiment described above, with regard to the regions of different wettability values formed on the surface of the lead 1 and the signal line 2, a particular set value of the wettability may be determined arbitrarily. At least the first lead region 1*a* is higher in wettability than the second lead region 1*b*, and the first signal line region 2*a* is higher in wettability than the second signal line region 2*b*. Further, from a sticking condition of the solder 5, at least the first lead region 1*a* may be higher in wettability than the second signal line region 2*b*, and the first signal line region 2*a* may be higher in wettability than the second lead region 1*b*.

In short, the relationship in magnitude of the wettability between the first lead region 1*a* and the first signal line region 2*a* is arbitrary, and also the relationship in magnitude of the wettability between the second lead region 1*b* and the second signal line region 2*b* is arbitrary.

Further, while, in the foregoing description of the embodiment, the state in which the surface of the board 7 extends vertically is a standard disposition posture, the disposition direction or the extending direction of the lead 1, signal line 2 and so forth may be determined arbitrarily. For example, in the case where the mass of the lead 1 is small and the influence of the gravity is low, operation of the lead 1 is controlled principally by the surface tension of the solder 5. Accordingly, it is possible, for example, to slidably move the lead 1 in a horizontal direction, slidably move upwardly in a vertical direction or the like.

Further, while, in the foregoing description of the embodiment and the modification, the configuration of the connector 10 for connecting substrates to each other is given as an example, a particular embodiment is not limited to this. For example, the connector can be applied to an electronic part such as, for example, a connector for attaching a semiconductor part or the like to a substrate or a connector (socket) for a processor.

As described above, according to the disclosed technology, at least one of effects or advantages described below can be achieved.

(1) The moving direction of the lead can be made coincide with the extending direction of the same.

(2) The smoothness in sliding movement of the lead can be enhanced.

(3) Movement of the lead in the widthwise direction can be constrained.

(4) Rotation of the lead can be suppressed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. An electronic part including a lead extending for sliding movement on and in an opposing relationship to a signal line and configured to join to the signal line through solder, comprising:

a first opposing face section including a pair of faces formed in an opposing relationship to each other on surfaces of the signal line and the lead and having wettability to the solder; and a second opposing face section including a pair of faces formed in an opposing relationship to each other on the surfaces of the signal line and the lead along an extending direction of the lead and having wettability lower than the wettability of said first opposing face section.

2. The electronic part according to claim 1, wherein said second opposing face section is formed in a shape having a center of figure at a center or a substantial center in a widthwise direction orthogonal to the extending direction of the lead on the surfaces of the signal line and the lead; and said first opposing face section is provided so as to sandwich said second opposing face section from the widthwise direction on the surfaces of the signal line and the lead.

3. The electronic part according to claim 2, wherein said first opposing face section is provided so as to sandwich said second opposing face section from the widthwise direction between two areas and is formed in a shape in which the two areas are contiguous to each other.

4. The electronic part according to claim 2, wherein a dimension of said first opposing face section of the lead in the widthwise direction is formed smaller than a dimension of said first opposing face section of the signal line in the widthwise direction.

5. The electronic part according to claim 2, wherein said second opposing face section is divided in the extending direction of the lead and disposed at a plurality of places.

6. The electronic part according to claim 2, wherein said second opposing face section is disposed in a plurality of columns juxtaposed in the widthwise direction.

7. The electronic part according to claim 2, wherein the lead includes, on the opposing face thereof to the signal line:

a first lead region which forms one face of said first opposing face section;

a second lead region which forms one face of said second opposing face section; and a third lead region formed zonally along the widthwise direction on one end side of the extending direction adjacent to the first lead region and having wettability lower than the wettability of the first lead region; and the signal line includes, on the opposing face thereof to the lead:

a first signal line region which forms the other face of said first opposing face section;

a second signal line region which forms the other face of said second opposing face section; and a third signal line region formed zonally along the widthwise direction on the other end side of the extending direction adjacent to the first signal line region and having wettability lower than the wettability of the first signal line region.

8. The electronic part according to claim 7, wherein the second signal line region and the third signal line region are formed in a mutually connected shape;

a dimension of an end, connected to the third signal line region, of the second signal line region in the widthwise direction is formed greater than a dimension of the other end of the second signal line region in the widthwise direction; and a dimension of one end, opposed to the second signal line region, of the second lead region in the widthwise direction is formed greater than a dimension of the other end of the second lead region in the widthwise direction.

9. The electronic part according to claim 7, wherein the lead includes, on the opposing face thereof to the signal line:

a fourth lead region formed zonally along the widthwise direction on the other end side of the extending direction adjacent to the first lead region and having wettability lower than the wettability of the first lead region.

10. The electronic part according to claim 9, wherein, where a dimension of the first lead region in the extending direction is represented by A and a dimension of the fourth lead region in the extending direction is represented by B while a dimension of the first signal line region in the extending direction represented by X, the values of the dimensions A, B and X are set to values which satisfy $X \leqq A+2B$.

11. A lead extending for sliding movement with respect to a signal line, which includes a first signal line region having wettability to solder and a second signal line region having wettability lower than the wettability of the first signal line region on a surface thereof and configured to join to the signal line through the solder, comprising:

a first lead region provided in an opposing relationship to the first signal line region and having wettability to the solder; and a second lead region provided in an opposing relationship to the second signal line region, formed along an extending direction of the lead and having wettability lower than the wettability of said first lead region.

12. The lead according to claim 11, wherein said second lead region is formed in a shape having a center of figure at a center or a substantial center in a widthwise direction orthogonal to the extending direction of the lead; and said first lead region is provided so as to sandwich said second lead region from the widthwise direction.

13. The lead according to claim 12, wherein said first lead region in which said second lead region is interposed has unified shape.

14. The lead according to claim 12, wherein a dimension of said first lead region in the widthwise direction is formed smaller than a dimension of the first signal line region in the widthwise direction.

15. The lead according to claim 12, wherein said second lead region is divided in the extending direction of the lead and disposed at a plurality of places.

16. The lead according to claim 12, wherein said second lead region is disposed in a plurality of columns juxtaposed in the widthwise direction.

17. The lead according to claim 12, wherein the lead is connected to the signal line through the solder, the signal line which includes a third signal line region having wettability lower than the wettability of the first signal line region and being formed zonally along the widthwise direction on one end side in the extending direction adjacent to the first signal line region; and the lead includes a third lead region formed zonally along the widthwise direction on the other end side of the extending direction adjacent to said first lead region and having wettability lower than the wettability of said first lead region.

18. The lead according to claim 17, wherein said second lead region and said third lead region are formed in a mutually connected to each other; and a dimension of one end, connected to said third lead region, of said second lead region in the widthwise direction is formed greater than a dimension of the other end of said second lead region in the widthwise direction.

19. The lead according to claim 17, further comprising a fourth lead region formed zonally along the widthwise direction on the other end side of the extending direction adjacent to said first lead region and having wettability lower than the wettability of said first lead region.

20. The lead according to claim 19, wherein, where a dimension of said first lead region in the extending direction is represented by A and a dimension of said fourth lead region in the extending direction is represented by B while a dimension of the first signal line region in the extending direction represented by X, the values of the dimensions A, B and X are set to values which satisfy $X \leqq A+2B$.

* * * * *